US005774957A

United States Patent [19]

Kohl et al.

[11] Patent Number: 5,774,957

[45] Date of Patent: Jul. 7, 1998

[54] JEWELRY CLASP

[76] Inventors: Thomas D. Kohl, 13895 Braun Rd., Golden, Colo. 80401; Kenneth Lucien Mino, 3770 Allison Ct., Wheat Ridge, Colo. 80033

[21] Appl. No.: 746,105

[22] Filed: Nov. 6, 1996

[51] Int. Cl.[6] ..... A44B 11/00; A44C 5/00

[52] U.S. Cl. ..... 24/701; 24/616; 24/702

[58] Field of Search ..... 24/701, 702, 666, 24/667, 616, 265 AL, 499; 63/12, 13

[56] References Cited

U.S. PATENT DOCUMENTS

| | | | |
|---|---|---|---|
| 281,088 | 7/1883 | Liddle | 63/13 |
| 956,342 | 4/1910 | Hamburger | 24/701 |
| 3,123,881 | 3/1964 | Westman | 24/701 |
| 4,426,854 | 1/1984 | Geldwerth et al. | 24/616 |
| 4,532,682 | 8/1985 | Murao | 24/616 |
| 4,539,736 | 9/1985 | Yokosuka | 24/702 |
| 4,783,974 | 11/1988 | Hernandez | 63/12 |
| 5,048,310 | 9/1991 | Riley | 63/13 |

FOREIGN PATENT DOCUMENTS

| | | | |
|---|---|---|---|
| 3017803 | 12/1980 | Germany | 24/701 |

OTHER PUBLICATIONS

Catalog for Naomi Manufacturing, 50th Anniversary Edition, pp. 28, 29, 31, 34, 35 and 37 (not numbered), (no date).

*Primary Examiner*—Victor N. Sakran
*Attorney, Agent, or Firm*—Holland & Hart LLP

[57] ABSTRACT

A clasp for use in attaching two body members together, especially pieces of jewelry, that provides secure attachment. The clasp includes a receptor member having a surface defining a slot and a connector member having a shaft, where the shaft is removably positionable in the slot to releasably connect the connector member to the receptor member. The connector member is moveable from an upright position where it can be inserted and removed from the receptor member, and a second, or seated, position, where it is resiliently restrained by the receptor member. The interaction between the connector member and the receptor member creates a connection that is not easily unintentionally released.

23 Claims, 11 Drawing Sheets

JEWELRY CLASP

BACKGROUND OF THE INVENTION

1. Field of the Invention

This invention relates to jewelry clasps, and more particularly relates to a new and improved jewelry clasp having a security feature which significantly reduces the occurrence of unintentional disconnections.

2. Description of the Prior Art

Jewelry has been worn for thousand of years by both men and women. Traditionally, jewelry such as bracelets and necklaces have required a clasp to allow the user to easily put on and take off the piece of jewelry. Jewelry is oftentimes expensive, and it is very important that the clasp be sufficiently strong and secure to facilitate safely holding the jewelry together about a person's neck or wrist, in addition to being able to support relatively heavy objects.

The presently available clasps used in bracelets and necklaces are convenient to use, but oftentimes lack strength and security. Problems arise when the clasp is used often, which causes the clasp to become insecure and inadvertently and unintentionally release to allow the bracelet or necklace to fall off of the user. In addition, if the jewelry is heavy, particularly in the case of a necklace, the clasp can fail, which also allows the jewelry to fall from the user and become damaged or lost.

There is a trend in jewelry style which emphasizes the modularity of combining certain jewelry styles, or combining certain jewelry together, depending on the desired look. The current methods of releasably attaching certain jewelry to other jewelry for the modularity feature include press pins such as standard pierced earring clasps, simple threaded screws, as well as complicated spring loaded clasps. The problem with the presently available clasps which allow modular jewelry use is that they are expensive and difficult to operate. With particular respect to spring loaded clasps, the structure is typically complex with minute latches. The complex structure of these types of clasps lend themselves to wearing out over time.

There is missing in the art a jewelry clasp which allows the user to easily and securely attach a necklace or bracelet together, and in addition there is missing in the art a clasp which allows the modular use of jewelry in a simple and secure manner.

SUMMARY OF THE INVENTION

The present invention in general terms concerns a clasp for use in attaching two body members together, especially pieces of jewelry, that provides a secure attachment mechanism. The clasp of the present invention overcomes many of the mentioned problems. The clasp is easy to use, strong, and has several applications on different types of jewelry, among several other important advantages that are discussed below.

The clasp of the present invention includes a receptor member having a surface defining a slot and a connector member having a shaft, where the shaft is positionable in the slot to releasably connect the connector member to the receptor member. In further detail, the shaft defines a transversely mounted cross member. Also, the shaft has a thickness dimension, and the slot has a width dimension and defines a second end, the width dimension reducing in width from the first end where the width dimension is larger than the thickness dimension of the shaft, to the second end where the width dimension is a minimum and is substantially equal to or less than the thickness dimension of the shaft.

In a second embodiment, the receptor member has an upper wall, a lower wall and an end wall, all together defining a recess. The slot is formed through the upper wall and the end wall, and extends from a first end on the upper wall to a second end on the end wall. A connector member has a main body, a shaft extending outwardly from the main body and a cross member formed at a distal end and extending transversely from the shaft. The cross member is positionable through the slot to engage the end wall of the receptor member. The connector member is moveable between an upright position and a seated position to resiliently separate the upper and lower walls during movement between the upright position and the seated position. The resilient interference by the upper and lower walls with the cross member as it is pivoted in the recess from the upright position to the seated position helps to trap the cross member in the seated position and keeps it from accidentally returning to the upright position.

In addition to connecting the ends of bracelets and necklaces, the clasp can be used to removably attach pendants to earrings, necklaces and bracelets by attaching the receptor member to the main body of the jewelry, and the pendant to the connector member. This allows for changing the look of the jewelry easily while safely attaching the pendant thereto.

Accordingly, it is a primary object of the present invention to provide a clasp that is easy to use and that securely attaches a jewelry piece together.

It is a further object of the present invention to provide a clasp that reduces the possibility of unintentional disconnection of the clasp.

Other aspects, features and details of the present invention can be more completely understood by reference to the following detailed description of a preferred embodiment, in conjunction with the drawings, and from the appended claims.

DETAILED DESCRIPTION OF THE INVENTION

Figure 1:
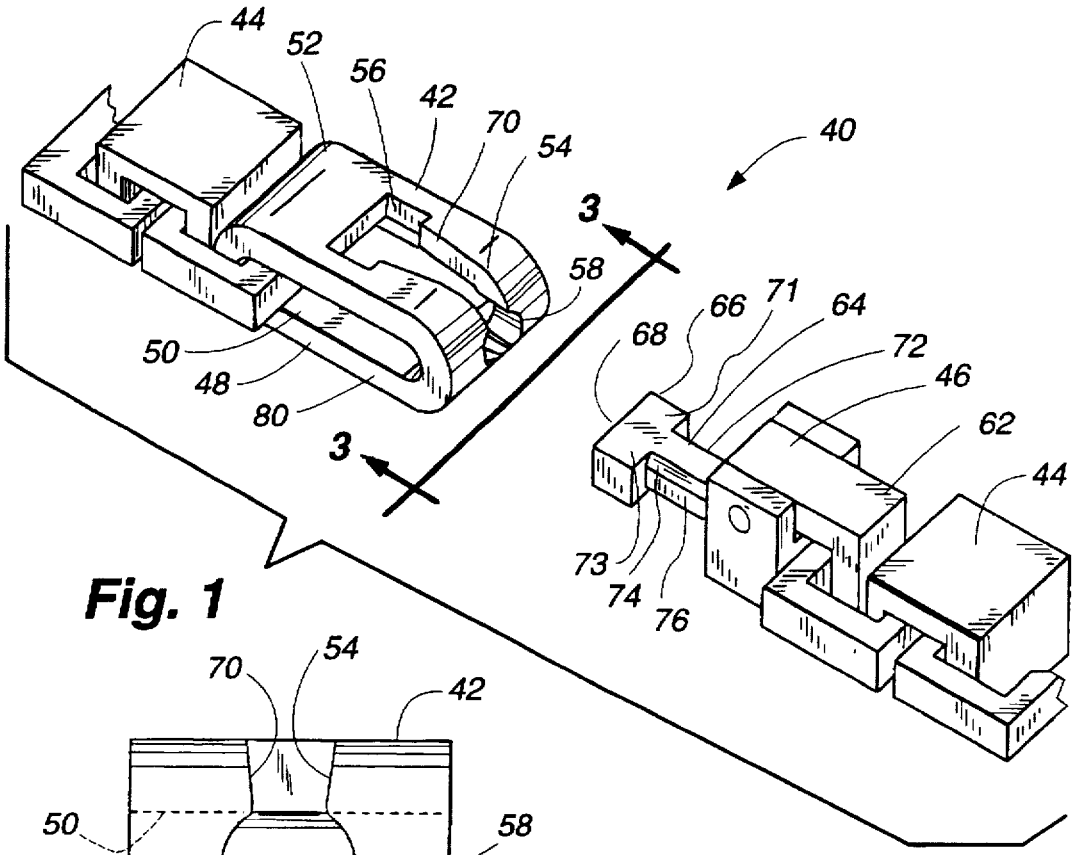
FIG. 1 is a perspective view of the first embodiment of the present invention and illustrates a connector segment attached to an end of a piece of jewelry, and a receptor segment attached to the opposite end of the piece of jewelry.

Referring first to FIG. 1, a first embodiment of the jewelry clasp 40 of the present invention is disclosed, and includes a receptor segment 42 attached to one end of a necklace 44 or bracelet, and a connector segment 46 attached to the opposite end of the necklace or bracelet. The receptor segment 42 has a main body 48 defining an oval shape forming a cavity 50, and a top portion 52 defining a channel 54 communicating with the cavity 50. The first end 56 of the channel 54 is at the center of the top portion 52 of the receptor segment 42, and extends to and terminates in a second end 58 of the channel 54 at the end 60 of the receptor segment 42.

Figure 2:
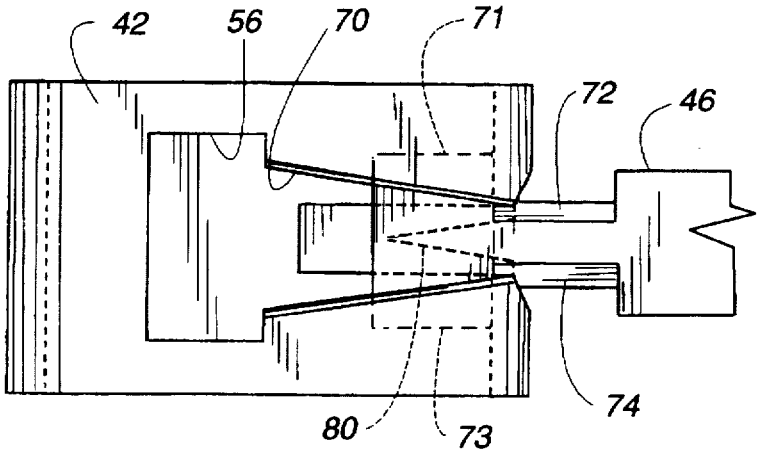
FIG. 2 is an enlarge plan view of the first embodiment of the clasp of the present invention when engaged.

The connector segment 46 includes a first end 62 for attachment to the necklace 44 or bracelet, a stem 64 extending from the first end 62, and a cross member 66 at the second end 68, the cross member 66 formed at the end of the stem 64. The connector segment 46 is releasably received into the receptor segment 42 by positioning the cross member 66 and a portion of the stem 64 adjacent to the cross member 66 into the channel in the receptor segment 42, and moving the connector segment 46 such that the cross member 66 and stem 64 move along the channel 54 to the second end 58 of the channel and become seated to extend from the receptor segment 42, as shown in FIG. 2. The cross member 66 of the connector segment 46 engages the walls 70 surrounding the channel 54 to releasably secure the connector segment 46 in the receptor segment 42. The extensions 71, 73 of the cross member 66 extend laterally to either side of the stem 64 to form a T-shape. With the extension arms 71, 73 positioned in the cavity 50 and the stem 64 extending through the channel 54, the connector segment 46 is securely attached to the receptor segment 42. The opposing extension arms 71, 73 engage the main body 52 of the receptor segment adjacent to and on either side of the channel 54. This engagement occurs at all locations along the channel 54 other than the first end 56 where the width of the channel 54 is such that the cross member 66 can fit therethrough into the cavity 50. The attachment between the connector segment 46 and the receptor segment 42 is strong and secure, and is easy to operate. Thus it is perfectly suited for use with expensive jewelry items or heavy jewelry items, and assists in eliminating unintentional disconnection of the jewelry ends, which could cause the jewelry to fall from the user and become damaged or lost.

Figure 3:
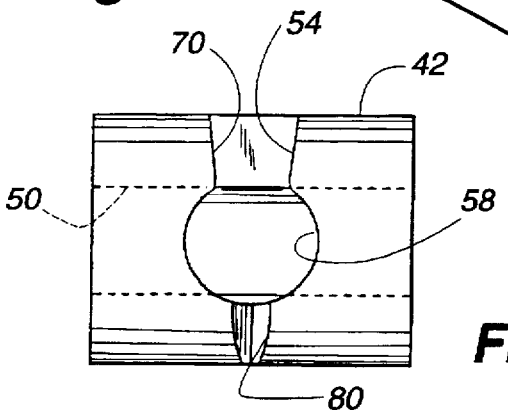
FIG. 3 is a representational section view taken through line 3—3 of FIG. 1 and illustrates the receptor segment.

In more detail, still referring to FIG. 1, the first end of the channel 56 has a width dimension substantially equal to or just larger than the width dimension of the cross member 66 on the connector segment 46. This allows the cross member 66 to be positioned through the first end 56 of the channel 54 and into the cavity 50. The width of the channel 54 from the first end 56 to the terminating or second end 58 of the channel decreases in the width dimension to be substantially equal to or just less than the width of the stem 64 portion of the connector segment 46. The second end 58 of the channel 54 has a width substantially equal to or just larger than the width dimension of the stem 64 portion of the connector segment 46, and can have a circular profile as shown in FIG. 3.

The stem 64 has four longitudinal edges 72, 74, 76, 78 (not shown) extending between the first end 62 and the cross member 66, with the longitudinal edges being angled for reasons discussed below.

In engaging the connector segment 46 with the receptor segment 42, the cross member 66 is first positioned through the first end 56 of the channel 54 into the cavity such that the stem 64 extends through the channel 54. The entire connector segment 46 is then moved toward the second end 58 of the channel 54 such that the stem 64 moves along the channel and the cross member 66 moves through the cavity 50. As the channel 54 becomes narrower, the slanted longitudinal edges 76, 78 on the stem 64 engage the walls 70 of the channel 54. As the stem 64 is moved further through the channel 54, edges 76, 78 act as cam surfaces to force the walls 70 of the channel 54 outwardly. The width dimension of the channel 54 at its narrowest point is substantially equal to or just less than the width dimension of the stem 64 such that when the stem 64 is positioned in the second end 58 of the channel, which is substantially equal to or just larger in dimension than the stem 64 of the connector segment 46, the stem 64 is snapped into place. As the stem 64 is moved through the minimum dimension of the channel 54, the receptor segment 42 resiliently deforms to allow the stem 64 to move through the channel. When the stem 64 is positioned in the second end 58 of the channel 64, the receptor segment 42 returns to its original shape to securely hold the stem in the second end 58 of the channel 54. The walls 70 of the channel 54 resiliently deform only a small amount to allow the stem 64 to pass there-through to the second end 58 of the channel 54.

With the stem 64 positioned in the second end 58 of the channel 54, the cross member 66 is seated in the end of the receptor segment 42. The connector segment 46 can pivot slightly in order to conform to movements of the jewelry to which the clasp 40 is connected without disconnecting the connector segment 46 from the receptor segment 42.

The snap fit of the stem 64 into the second end 58 of the channel 54 keeps the stem positioned therein and minimizes unintentional disconnection of the connector segment 46 from the receptor segment 42, as shown in FIG. 2. This secure design also provides great strength in the design of the clasp 40 since the present invention requires no finely dimensioned, and as a result, structurally weak members.

The channel 54 continues from its second end 58 a short distance into the lower portion 80 of the receptor segment 42, and terminates in a thin V-shape. The thin V-shape facilitates the spring bias action of the channel walls 70 as the stem is moving through the minimum dimension of the channel 54 to reach the second end 58.

To disconnect the connector segment 46 from the receptor segment 42, the top slanted longitudinal edges 72, 74 of the stem 64 engage the opposing walls 70 of the channel 54 at the minimum channel width dimension, which is preferably adjacent to the second end 58 of the channel 54, and act as a cam surface to allow the stem to resiliently separate the walls 70 of the channel a sufficient amount to allow the stem to move through the channel. If the longitudinal edges were square, the structural transition between the second end 58 of the channel 54 and the length of the channel would need to have a cam surface thereon to facilitate the entry of the stem 64 into the portion of the channel 54 having a minimal width dimension.

Referring now to FIGS. 4 through 8, a second embodiment of the present invention is shown. In this embodiment, similar structural members are provided with the same label as in the previous embodiment, but are provided distinct reference numerals for clarity purposes. The receptor segment 84 shown in FIG. 4 defines a channel 86 extending along its top portion 88 and communicates with the cavity 90 formed therein, the channel terminating at a second end 92 formed at the end 94 of the receptor segment 84. A first end 96 of the channel 86 has the largest width dimension, while the width of the channel 86 continually narrows along the length dimension 98 to the second end 92. The second end 92 has a larger width dimension than the narrowest width dimension along the length 98 of the channel 86.

Figure 4:
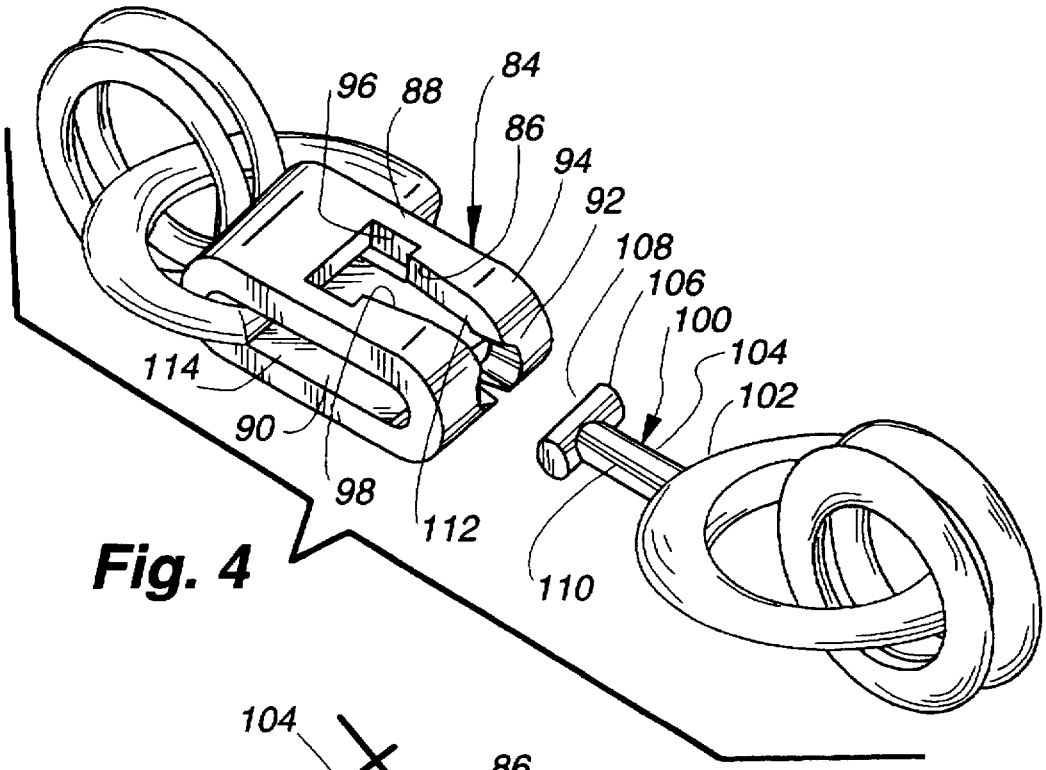
FIG. 4 is a perspective view of a second embodiment of the present invention and illustrates a connector segment attached to an end of a piece of jewelry, and the receptor segment attached to an opposite end of the piece of jewelry.

The connector segment 100 of the clasp as shown in FIG. 4 has a first end 102 for connecting to the bracelet or necklace as necessary, a stem 104 portion extending from the first end 102, and a cross member 106 at a second end 108 attached in a transverse orientation to the length 98 of the stem 104. The stem 104 has a cylindrical shape, as does the cross member 106. The minimum width dimension of the channel 86 is substantially equal to or slightly smaller than the maximum dimension of the stem 104, in this case the diameter. The second end 92 of the channel 86 has a dimension substantially equal to or slightly larger than the maximum dimension of the stem 104.

Figure 5:
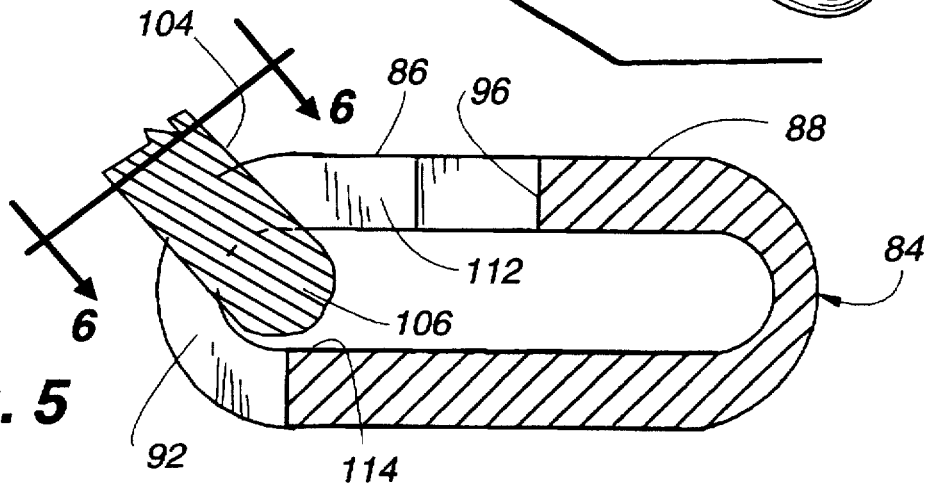
FIG. 5 is a representational section of the connector segment engaged with the receptor segment prior to becoming seated in said receptor segment.
Figure 6:
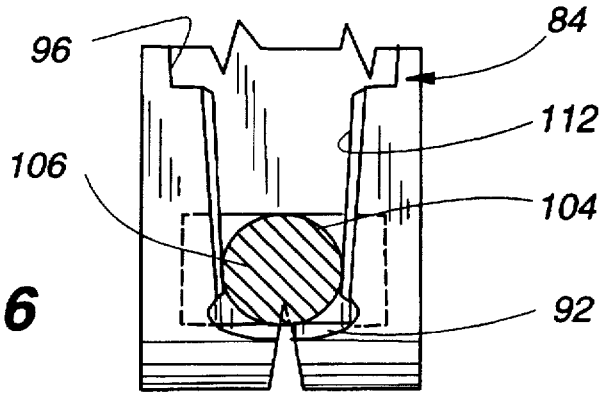
FIG. 6 is a section taken along line 6—6 of FIG. 5.
Figure 8:
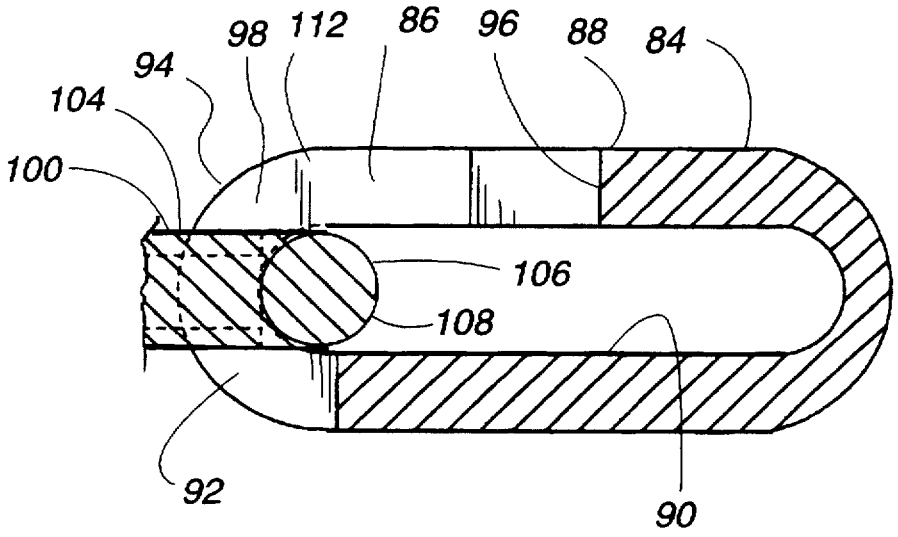
FIG. 8 is a section taken along line 8—8 of FIG. 7.
Figure 7:
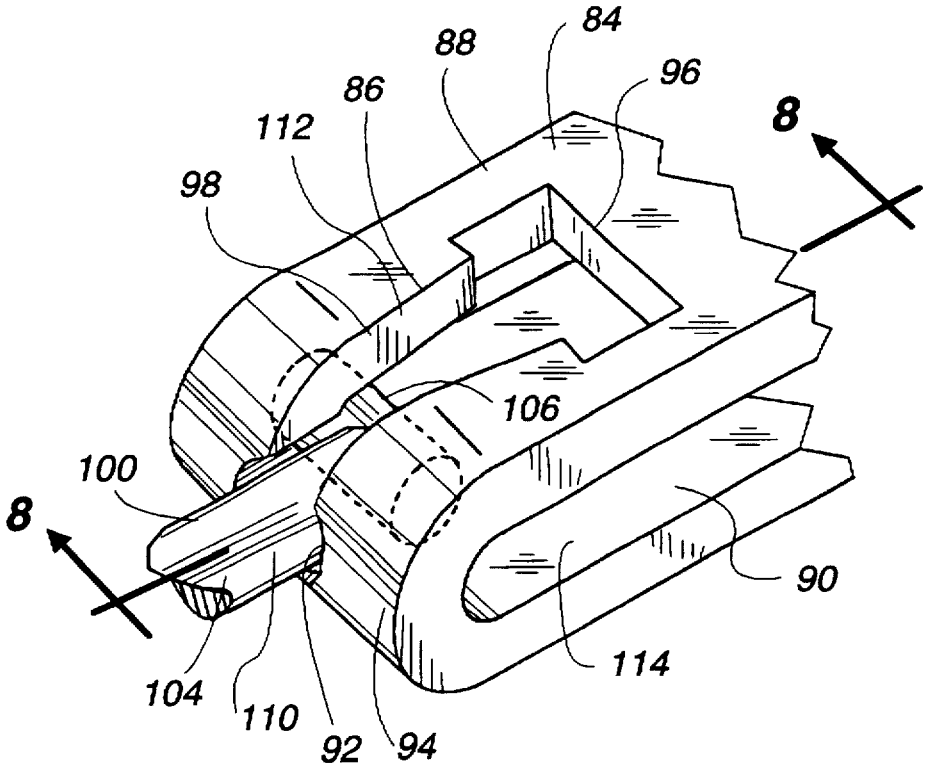
FIG. 7 is an enlarged perspective view of the second embodiment of the present invention and illustrates the connector segment seated in the receptor segment.

After the cross member 106 is inserted through the first end of the channel 86 into the cavity 90, the stem 104 is then moved along the channel 86 toward the second end 92, as shown in FIGS. 5 and 6. The curved outer surface 110 of the stem 104 acts analogously to the angled longitudinal edges 72, 74, 76, 78 of the first embodiment to facilitate the resilient deformation of the walls 112 of the channel 86 to allow the stem 104 to pass through the channel 86. When the stem 104 moves to the second end 92 of the channel 86 the walls 112 of the channel spring back to snap the stem 104 into the second end 92 of the channel 86 as shown in FIG. 7. With the stem 104 positioned in the second end 92 of the channel 86, the cross member 106 is thus seated in the receptor segment 84. The cross member 106 engages the walls 1 14 of the cavity 90 adjacent to the second end 92 of the channel 86. The connector segment 100 is thus held securely in the receptor segment 84 to minimize the unintentional disconnection of the connector 100 from the receptor segment 84.

To disconnect the connector segment 100 from the receptor segment 84, the stem 104 is moved from the second end 92 of the channel 86 toward the first end 96 of the channel 86 where the cross member 106 can be retracted through the first end 96 of the channel 86 from the cavity 90. As the stem 104 is moved from the second end 92 of the channel 86 into the length 98 of the channel 86, the curved surface 110 of the cylindrical body of the stem 104 facilitates resiliently biasing the walls 112 of the channel in an outward direction to allow the stem 104 to pass along the length 98 of the channel 86 to the first end 96.

The benefit of this design is that in each embodiment the stem 104 must be intentionally moved into and through the channel 86 to disconnect the connector segment from the receptor segment. This is unlikely to occur accidentally or unintentionally.

Referring to FIGS. 9 through 16, a third embodiment of the present invention is disclosed. As with the previous embodiments, similar structural members will be given the same label, however, the reference numerals will be unique for clarity purposes. In this third embodiment of the clasp 40 of the present invention, the connector segment 116 includes a first end 118 for attachment to a piece of jewelry, a stem 120 extending from the first end 118 and having a square or rectangular cross section, and a cross member 122 attached to the stem 120 at the second end 124. The cross member 122 extends laterally outwardly from the stem 120 to a width substantially equal to the width of the first end 118 of the connector segment 116. The cross member 122 has an upper 126 and lower 128 laterally extending leading edges which form a curved transition from a top surface 130 of the cross member 122 to a front surface 132 of the cross member 122, and from the front surface 132 of the cross member 122 to the bottom surface 134 of the cross member 122 respectively. On either side of the stem 120, where it connects to the cross member 122, the cross member 122 defines an upper 136 and lower 138 trailing edge which creates a curved transition from the top surface 130 of the cross member 122 to the rear surface 140 of the cross member 122, and from the rear surface 140 of the cross member 122 to the bottom surface 134 of the cross member 122, respectively. These laterally extending edges 126,128,136,138 have a radius of curvature of approximately 0.012 inches ±0.002 inches.

The receptor member 142 of the third embodiment defines a channel 144 extending from a mid point on the top portion 146 around the end 148 of the receptor segment 142 and terminating there in a second end 150. The first end 152 of the channel 144 has a width dimension sufficient to receive the cross member 122 of the connector segment 116 in a transverse orientation. Adjacent the first end 152 of the channel 144 is a sloped surface 154 having a width substantially equal to the width of the first end 152 of the channel 144 yet sloping downwardly from the top surface 156 of the top portion 146 of the receptor segment 142 to the bottom surface 158 of the top portion 146 of the receptor segment 142. The sloped surface 154 forms a guide for assisting the user in properly positioning the cross member 122 for insertion through the first end 152 of the channel 144. The channel 144 has a constant width along its length from the first end 152 to the second end 150, which is substantially equal to or slightly greater than the width dimension of the stem 1207 and allows passage of the stem therethrough, as described below.

Figure 9:
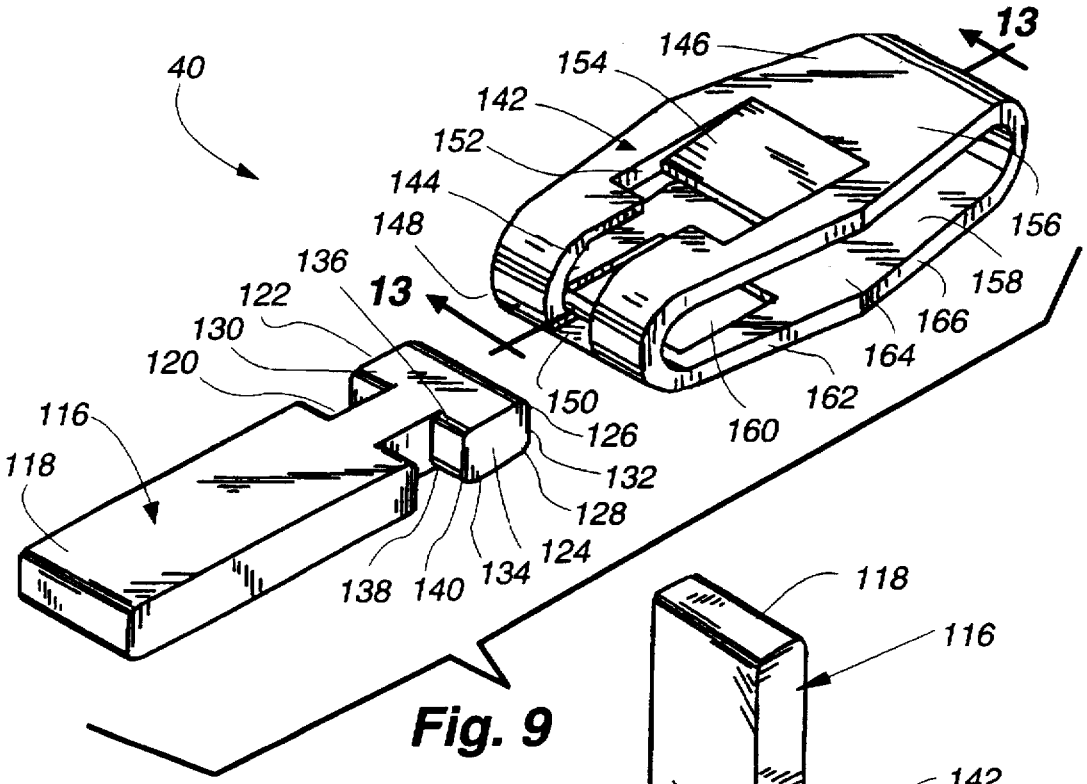
FIG. 9 is a perspective view of a third embodiment of the present invention, and illustrates a receptor segment and a connector segment.
Figure 16:
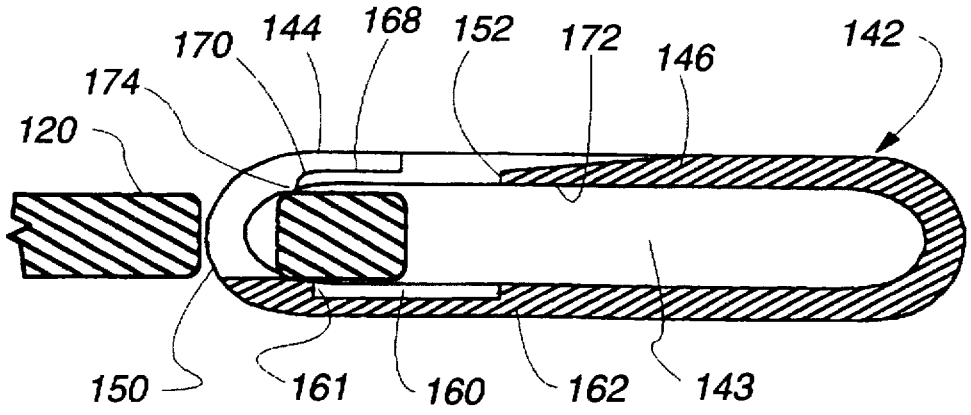
FIG. 16 is a section taken along line 16—16 of FIG. 12.
Figure 13:
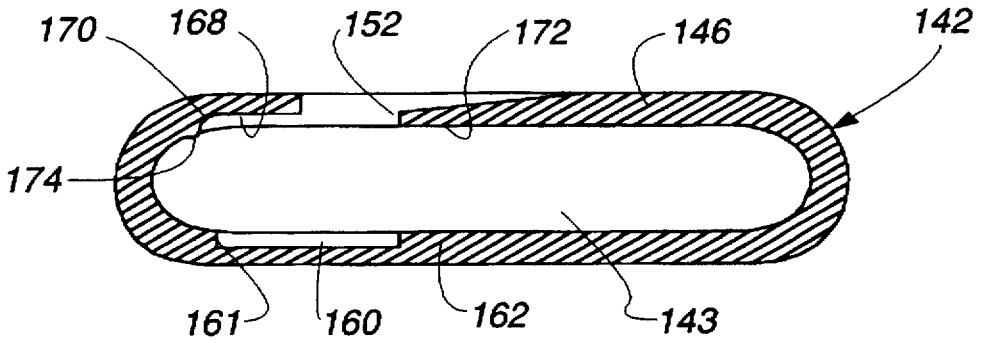
FIG. 13 is a section taken along line 13—13 of FIG. 9.
Figure 14:
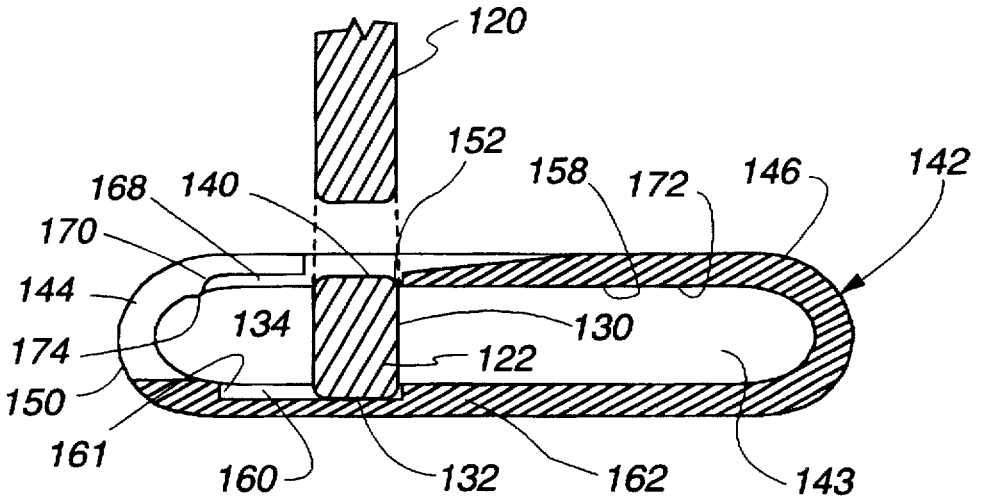
FIG. 14 is a section taken along line 14—14 of FIG. 11.

A recess 160 is formed in the bottom cavity wall 162 (the top surface 164 of the bottom portion 166) directly below and substantially coextensive with the first end 152 of the channel 144. The recess 160 extends only partially through the thickness of the bottom portion 166 of the receptor segment 142. The recess 160 extends along the bottom portion 166 coextensive with the length of the channel 144 toward the second end 150 of the channel 144, as best seen in FIGS. 9 and 13. A recess 168 is formed in the top cavity wall 170 of the receptor segment (the bottom surface 172 of the top portion 146) and is adjacent to the first end 152 of the channel 144 and extends along either side of the channel 144 and terminates just prior to the second end 150 of the channel 144, as best shown in FIG. 16. The recess 168 in the top cavity wall 170 of the receptor segment 142 extends to substantially the same point along the channel 144 as the recess 160 in the bottom cavity wall 162 of the receptor segment 142. The recess 168 in the top wall 170 of the receptor segment 142 is best shown in FIG. 9,13 and 14.

A cam surface 174 extends downwardly into the cavity 143 from the top wall 170 of the receptor member 142. The cam surface 174 is positioned at the end of the recess 168 in the top wall 170 of the receptor segment 142, between the recess 168 and the second end 150 of the channel 144. The cam surface 174 is formed in the top wall 170 of the receptor segment 142 and extends laterally on either side of the channel 144. The dimension from the recess 160 in the bottom wall 162 to the recess 168 in the top wall 146 is substantially equal to or slightly greater than the dimension of the cross member 122 from the front surface 132 to the rear surface 140. The dimension of the distance between the bottom wall 162 to the cam surface 174 is substantially equal to or preferably slightly less than the dimension of the cross member 122 from the top surface 130 to the bottom surface 134. The importance of these relative dimensions will be described below.

Figure 10:
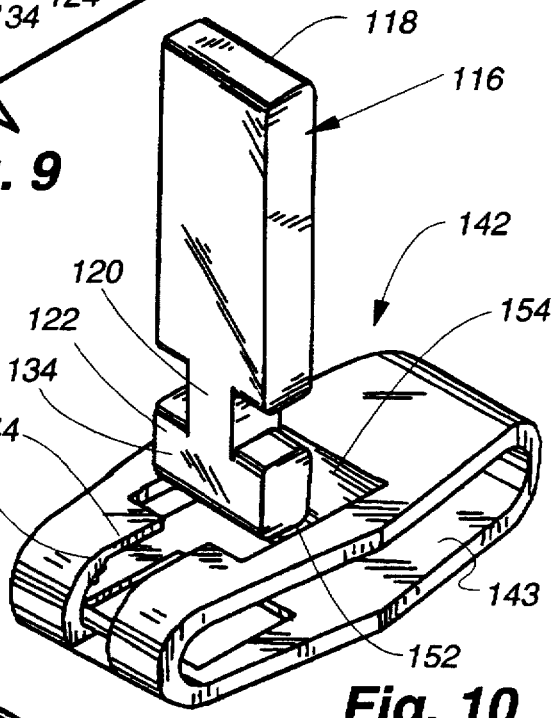
FIG. 10 is a perspective view of the third embodiment of the present invention as shown in FIG. 9, and illustrates the connector segment positioned for insertion into the channel of the receptor segment.
Figure 11:
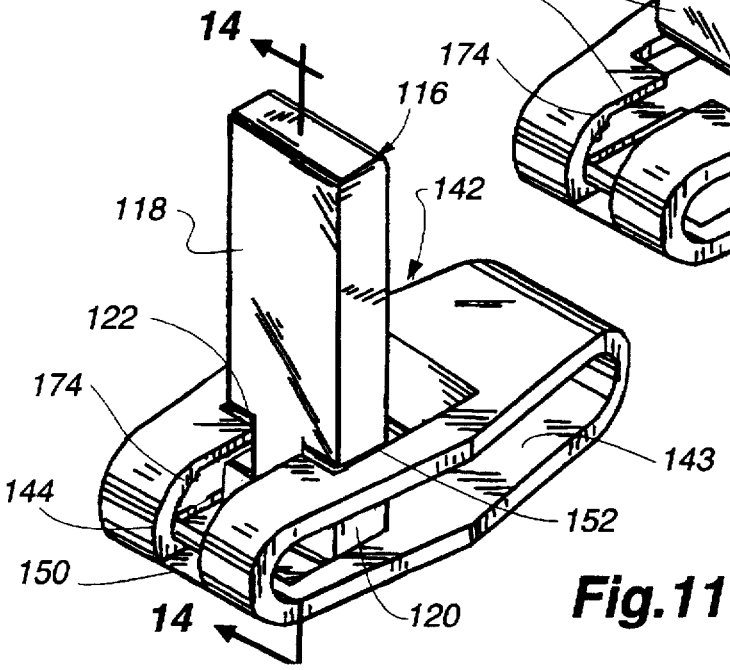
FIG. 11 is a perspective view of the third embodiment of the present invention as shown in FIG. 10, and illustrates the connector segment inserted through the channel of the receptor segment.
Figure 12:
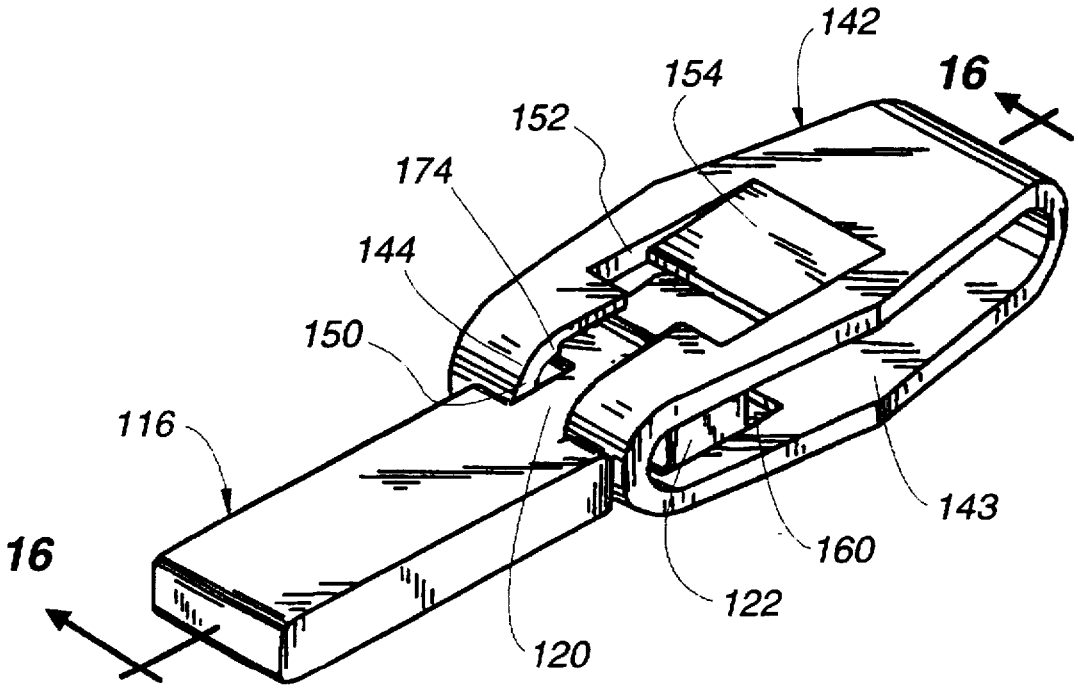
FIG. 12 is a perspective view of the third embodiment of the present invention, and illustrates the connector segment seated in the channel of the receptor segment.

As shown in FIGS. 9 through 12, to connect the connector segment 116 to the receptor segment 142, the connector segment 116 is oriented above the first end 152 of the channel 144 in a vertical position (see FIG. 10). The sloped surface guide 154 can be used to properly position the cross member 122 for insertion through the first end 152 of the channel 144 if desired. To use the guide, the cross member 122 is simply positioned in the guide and moved down the sloped surface 154 toward the first end 152 of the channel 144. Once the cross member 122 is positioned over the first end 152 of the channel 144, the cross member 122 can be inserted through the first end 152 of the channel 144 and into the cavity 143. Once in the cavity 143 (FIG. 14), the stem of the connector segment 116 is moved along the length of the channel 144 until the bottom surface 134 of the cross member 122 engages the edge 161 of the recess 160 adjacent to the second end 150 of the channel 144. As the cross member 122 engages the front edge 161 of the bottom recess 160, the cross member 122 and connector segment 116 rotates to a horizontal position which moves the stem 120 further through the channel 144. The cross member 122 is then wedged between the downwardly extending cam surface 174 from the top wall 170 of the cavity 143 and the bottom wall 162 of the cavity 143 to provide a snap fit of the cross member 122 into the seated position with the stem 120 in the second end 150 of the channel 144 (FIG. 16).

The engagement of the cross member 122 between the downwardly extending cam surface 174 and the bottom wall 162 of the cavity 143 causes the top 170 and bottom 162 walls of the cavity 143 to resiliently deform and thus clamp the cross member 122 in position. In this embodiment, the cross member 122 is engaged in the cavity 143 of the receptor member 142 by the cam surface 174 and the bottom wall 162 of the cavity.

As shown in more detail in FIGS. 13 through 16, when the cross member 122 is inserted through the first end 152 of the channel 144, as shown in FIG. 14, the dimension of the cross member 122 between the front surface 132 and the rear surface 140 is substantially equal to or slightly less than the dimension of the distance between the recess 160 in the bottom wall 162 of the cavity 143 and the recess 168 in the upper wall 170 of the cavity 143. This allows the cross member 122 to be moved in this vertical orientation along the cavity 143, which in turn moves the stem 120 along the length of the channel 144 toward the second end 150 of the channel 144.

Figure 15:
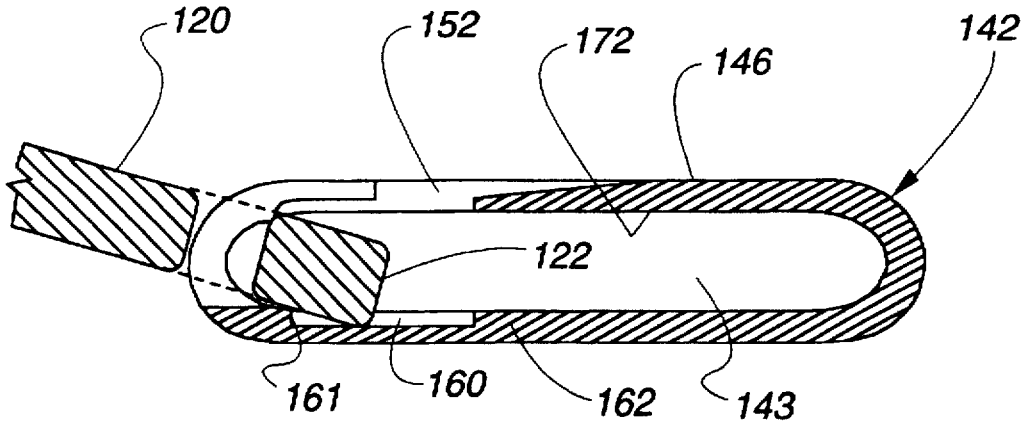
FIG. 15 is a representational section of the third embodiment of the present invention with the connector segment partially seated in the receptor segment.

As shown in FIG. 15, when the cross member 122 engages the front edge 161 of the recess 160 in the bottom wall 162 of the cavity 143, it causes the cross member 122 to rotate to a horizontal position from the vertical position. This rotation moves the stem 120 along the channel 144 to the second end of the channel 144, and also forces the cross member 122 to engage and slide past the cam surface 174 which pinches or clamps the cross member 122 between it and the bottom wall 162 of the cavity 143. The rounded lateral edges 136 of the cross member 122 allows the cross member 122 to engage and slide past the downwardly extending cam surface 174, which resiliently biases the cam surface 174 (and thus upper wall) upwardly, and in turn creates the compression force to clamp the cross member 122 in the seat of the receptor member 142. This clamping force keeps the cross member 122 releasably positioned such that unintentional disengagement of the connector member 116 from the receptor member 142 is unlikely. Under normal circumstances, the connector member 116 and the receptor member 142 can only be disengaged by deliberate and intentional movement of the connector member 116 within the receptor member 142. FIG. 16 shows the cross member 122 clamped between the cam surface 174 and the bottom surface 172 of the receptor member 142.

To remove the connector segment 116 from the receptor segment 142, the connector segment must first be pivoted from the horizontal position where it is seated in the second end 150 of the channel 144 to a more vertical position. During this rotation, the cross member 122 resiliently biases the top and bottom walls of the receptor segment 142 away from each other. Once the connector segment 116 is oriented in a substantially vertical position, the connector segment can be translated through the channel to the first end and removed from the channel for disconnecting the receptor segment from the connector segment.

Figure 17:
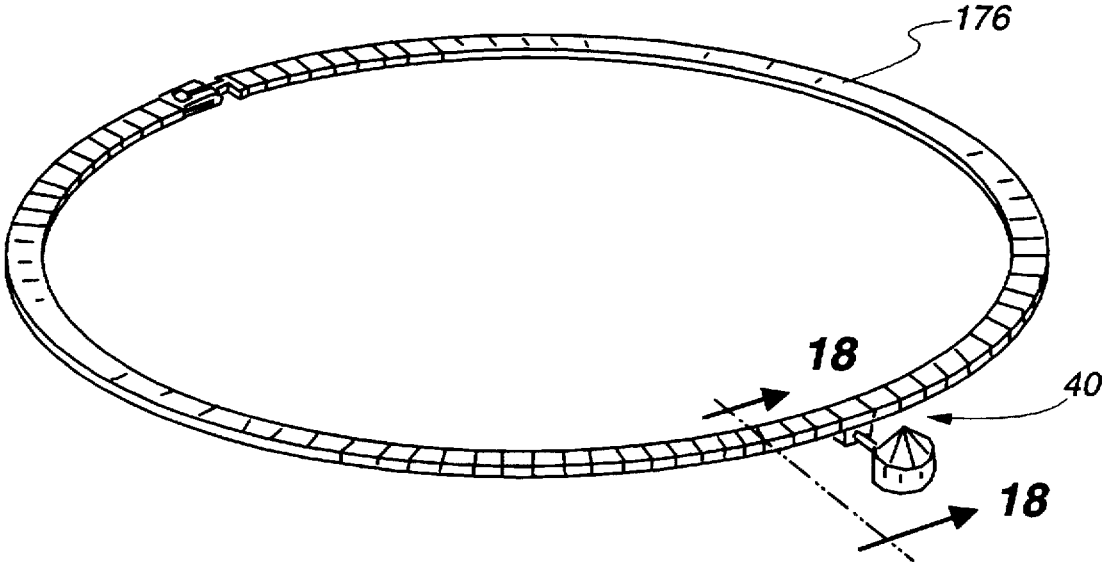
FIG. 17 is a perspective view of the second embodiment of the present invention showing the clasp used as a pendant attachment to a necklace.
Figure 18:
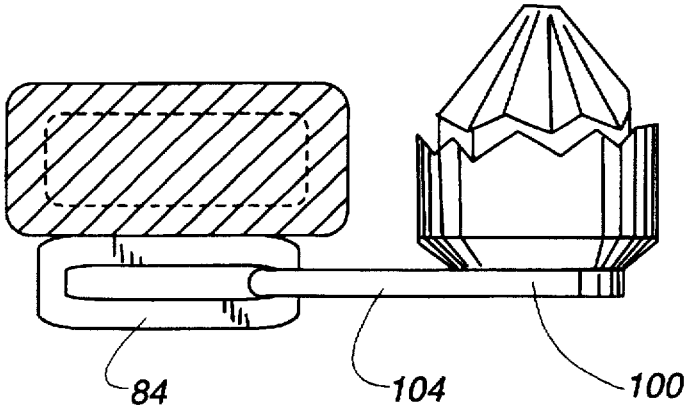
FIG. 18 is a section taken along line 18—18 of FIG. 17.
Figure 19:
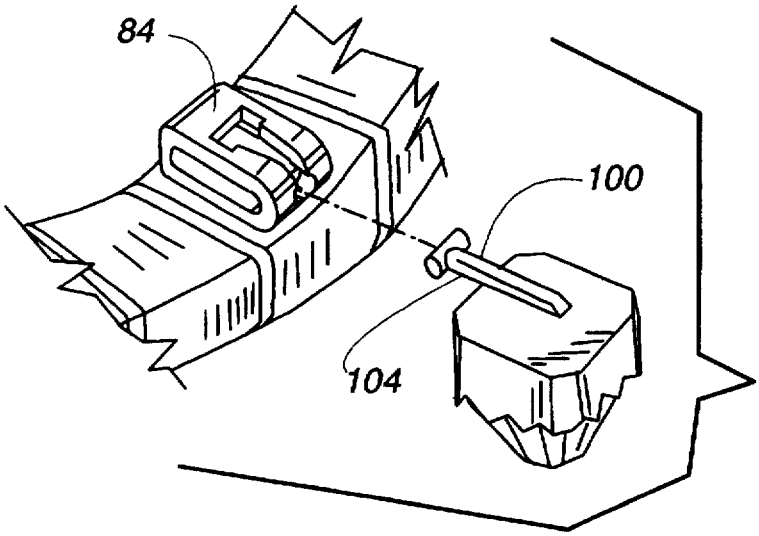
FIG. 19 is an enlarged perspective view of the second embodiment of the present invention as shown in FIG. 18, and illustrates the connector segment and the receptor segment prior to insertion of the connector segment into the receptor segment.

FIGS. 17 through 21 portray two of the multitude of uses of the embodiments of the present invention. In FIGS. 17 through 19, the use of the second embodiment of the clasp 40 of the present invention is shown as releasably attaching a pendant to a necklace. In FIG. 17, a necklace 176 is shown which includes the clasp 40 of the present invention to releasably attach a jeweled pendant thereto. The receptor member 84 of the clasp 40 of the present invention is attached to part of the necklace 176. The connector member 100 is attached to the pendant 178, in such a manner as to allow the stem 104 to extend therefrom to allow the stem to engage the receptor member 84 as described above. It should be understood that any of the other embodiments could also be used. With this type of use, the clasp 40 of the present invention can be utilized to allow the user to add pendants to necklaces or bracelets depending on the user's desire. The pendant can be easily connected and disconnected from the necklace by way of the inventive clasp 40.

Figure 21:
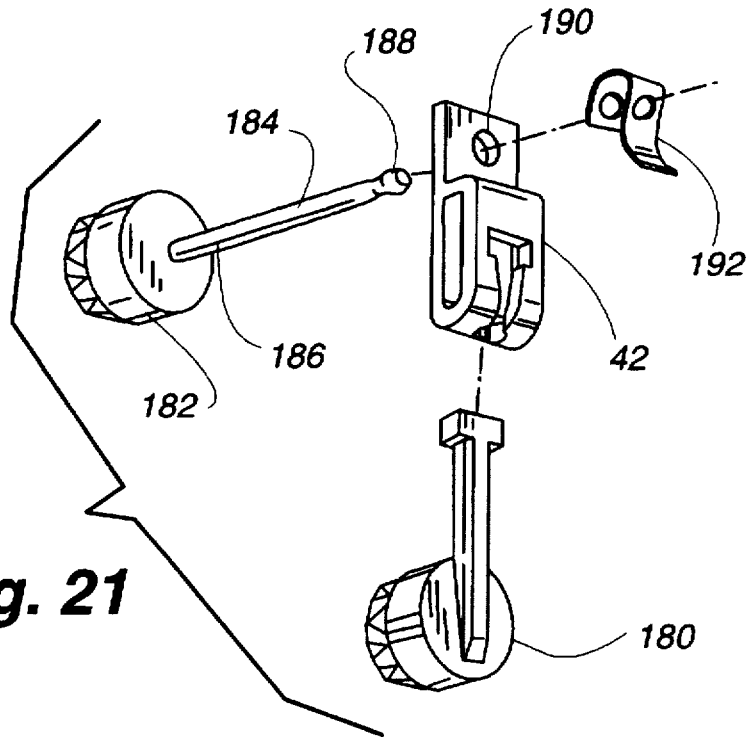
FIG. 21 is an exploded view of the first embodiment of the present invention as shown in use in FIG. 20.
Figure 20:
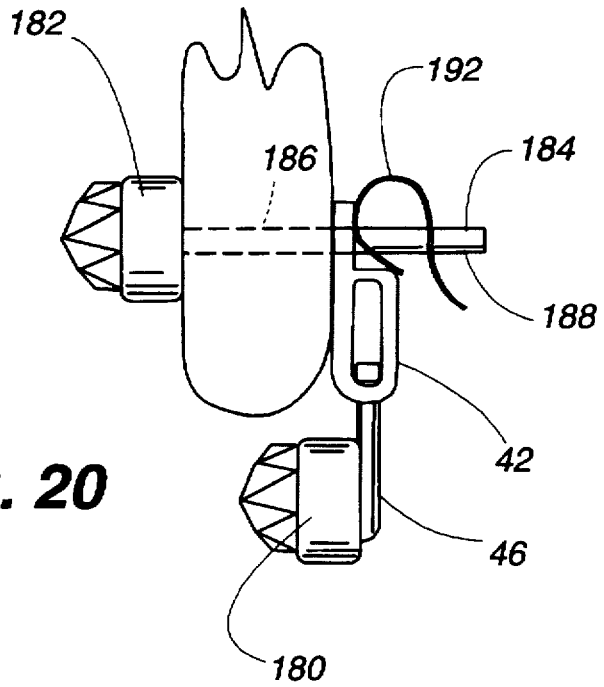
FIG. 20 is an enlarged side view of the first embodiment of the present invention and illustrates the inventive clasp used as an earring accessory.

FIGS. 20 and 21 disclose the use of the clasp of the present invention in attaching an additional piece of jewelry 180, such as a pendant, to an earring 182 for pierced ears. The earring 180 for pierced ears has a shaft 184 having a first end 186 to which the main earring 180 is attached, and a second end 188 on which a fastening device is positioned after the shaft is placed through the user's ear. In the use of the inventive clasp as shown in FIGS. 20 and 21, the receptor member 42 is fashioned to have an aperture 190 that fits over the shaft 184 between the user's ear and the fastening clasp 192. The additional earring portion is attached to the connector member 46 for releasable attachment to the receptor member 42 as desired by the user.

A fourth embodiment of the present invention is disclosed in FIGS. 22–28. As with the previous embodiments, similar structural members will be given similar labels, however, the reference numerals will be unique for clarity purposes. In this fourth embodiment, the receptor member 200 defines a channel 202 extending from a first end 204 positioned in the middle of the top wall 206 of the receptor member and extending around an end 208 of the receptor member 200 to terminate in a second end 210. As shown, the channel 200 has a first width dimension adjacent the first end 204 of the channel 202, and a second width dimension adjacent the second end 210 of the channel 202 for reasons described below. However, it should be understood that the channel in this fourth embodiment can have a single consistent width dimension.

The connector member 212 includes a shaft 214 terminating in a cross member 216, the cross member extending away from the shaft in a "T" formation. The cross member 216 has a rectangular cross section, and defines a top surface 218, a bottom surface 220, and opposing side surfaces 222, 224.

Figure 23:
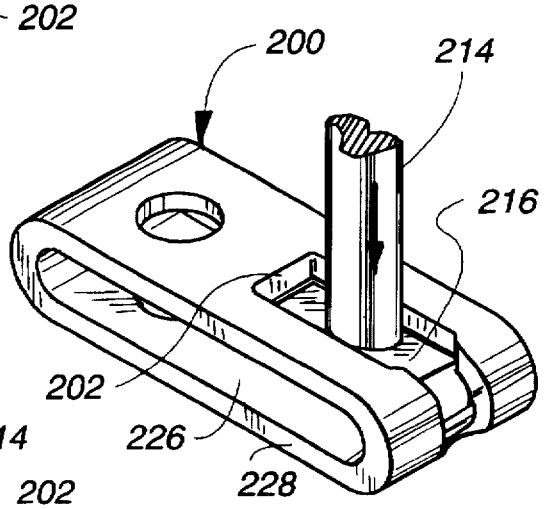
FIG. 23 is a perspective view, similar to FIG. 22, of the connector segment inserted through the slot in the receptor segment.

The connector member 212 is secured in the receptor member 200 by inserting the connector member 212 through the channel 202 adjacent the first end 204 thereof, with the connector member 212 oriented to have the cross member 216 parallel to, or in line with, the extension of the channel 202. Once the connector segment 212 is inserted through the channel 202 into the recess 226 of the receptor member 200, as shown in FIG. 23, the connector member is rotated an angle of 90 degrees with respect to the longitudinal axis of the shaft 214. This positions the cross member 216 to extend transversely of the channel 202 and keeps the connector segment 216 from being pulled out of the receptor segment 200.

Figure 22:
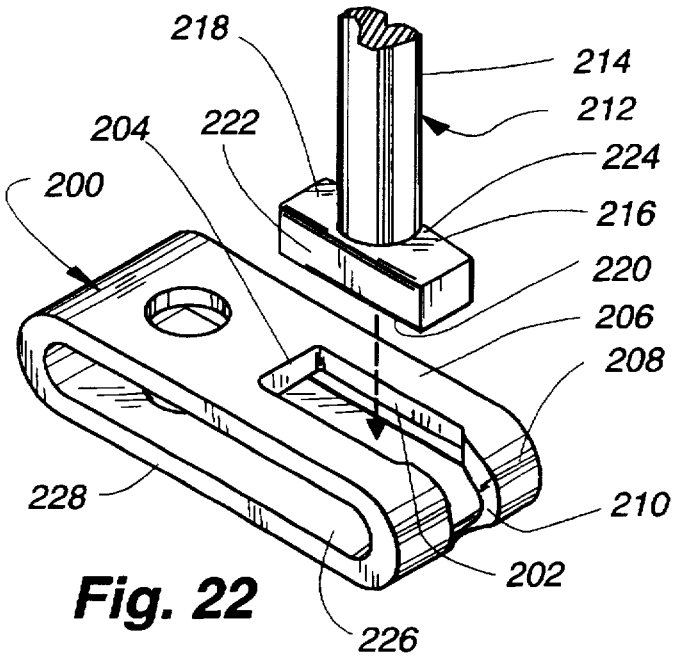
FIG. 22 is a perspective view of a fourth embodiment of the present invention, and illustrates the receptor segment and the connector segment prior to connection.
Figure 24:
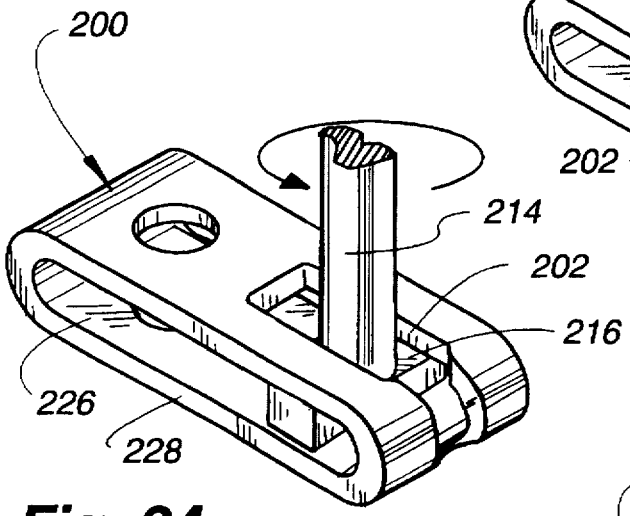
FIG. 24 is a perspective view, similar to FIG. 22, of the connector segment being rotated while positioned through the slot in the receptor segment.
Figure 25:
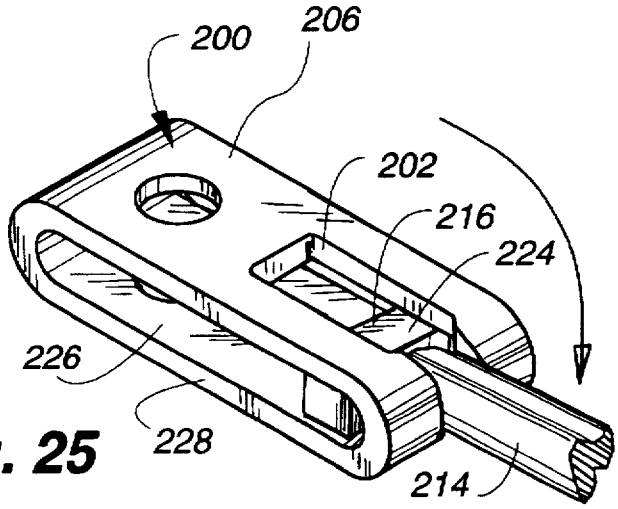
FIG. 25 is a perspective view, similar to FIG. 22, of the connector segment having been pivoted from the upright position to the seated position in the receptor segment.

In order to positively clamp the connector segment 212 in the receptor segment 200, the connector segment 212 is then pivoted about an axis extending through the cross member 216 to move the shaft 214 from a vertical position as shown in FIGS. 22–24 to a horizontal position as shown in FIG. 25. In pivoting the connector member 212, the cross member 216 also pivots, and when the section of the cross member 216 is positioned diagonally within the recess 226 formed in the receptor member during this pivoting motion, the diagonal corners of the cross member resiliently bias the top 206 and lower 228 walls of the receptor member 200 outwardly such that when the connector member 212 is fully pivoted, and the cross member 216 is no longer diagonally oriented in the recess, the top 206 and lower 228 walls regain their normal spaced relationship to clamp the cross member 216 therebetween.

Figure 26:
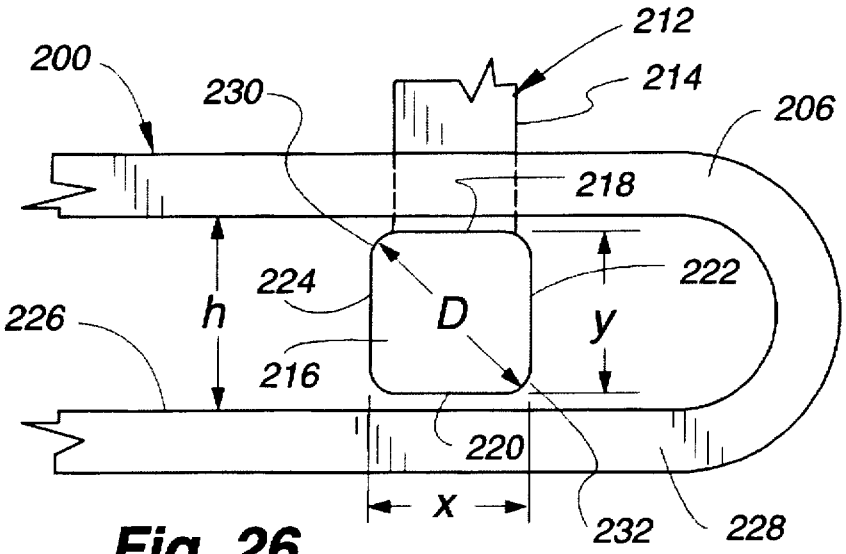
FIG. 26 is a representative view of the fourth embodiment of the clasp of the present invention, illustrating the cross member of the connector segment positioned in the recess of the receptor member.
Figure 27:
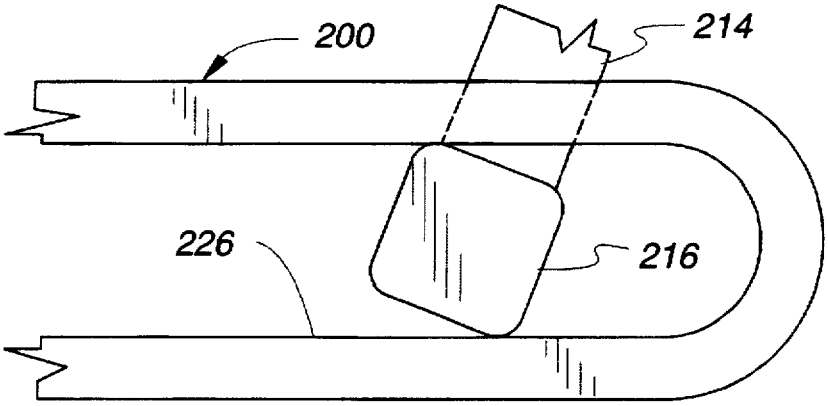
FIG. 27 is a representative view, similar to FIG. 26, of the cross member being pivoted to a second, or seated, position in the recess.
Figure 28:
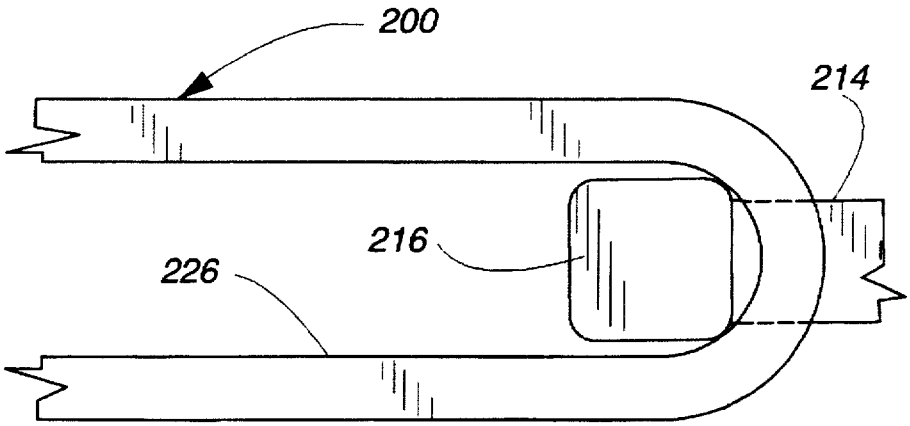
FIG. 28 is a representative view, similar to FIG. 26, of the cross member seated in the recess of the receptor member.
Figure 29:
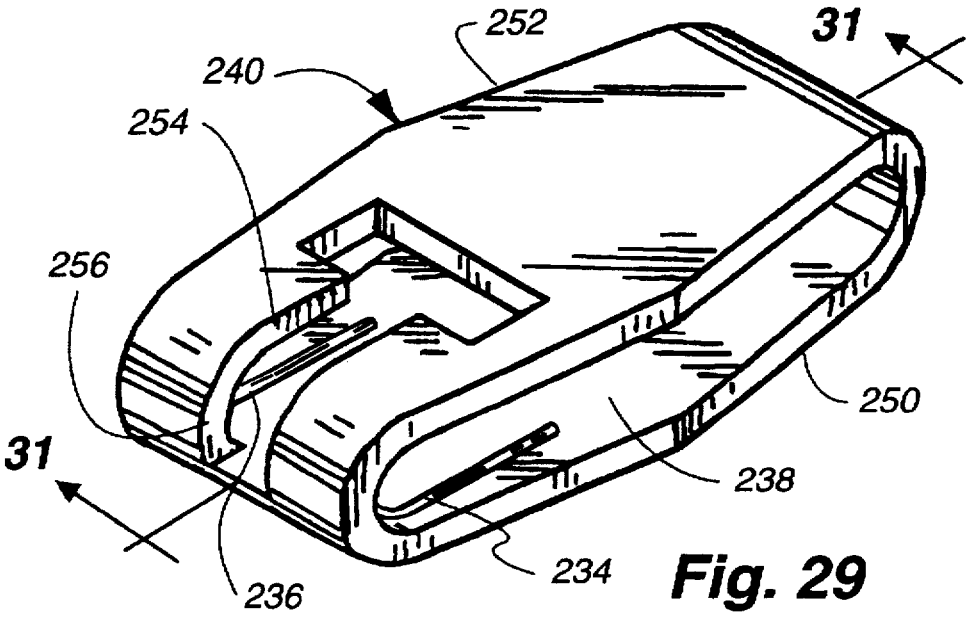
FIG. 29 is a perspective view of a receptor member, and illustrates guide rails formed on the recess walls adjacent the slot.
Figure 30:
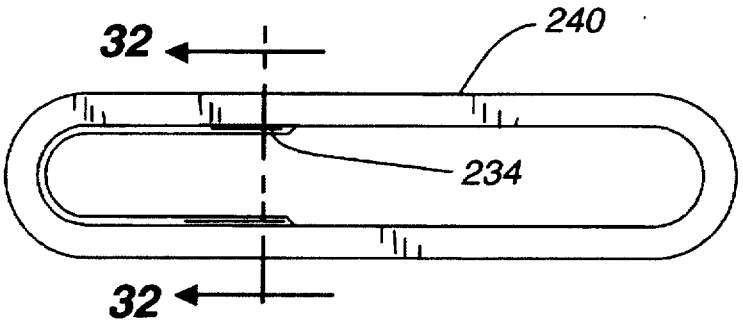
FIG. 30 is a representative section showing the cross member seated in the receptor, member having the guide rails.
Figure 31:
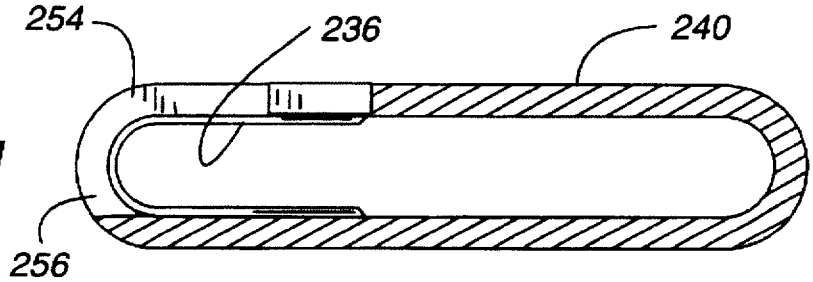
FIG. 31 is a section taken along lines 31—31 of FIG. 29.

This clamping action is shown in more detail in representative FIGS. 26, 27 and 28. As shown in FIG. 26, the receptor member 200 defines top 206 and lower 228 walls spaced apart by a dimension H which is preferably 0.060 inches. The cross member 216 has a dimension Y between the top 218 and bottom 220 faces, which is 0.056 inches, and a dimension X between the opposing side faces 222, 224 which is preferably 0.052 inches. The edges formed at the intersection of the top 218, bottom 220 and opposing side walls 222, 224 are rounded. The dimension D between diagonally opposing edges 230, 232 is preferably 0.068 inches. When the connector segment 200 is pivoted about an axis formed through the cross member 216, the engagement of diagonally opposing edges 2301, 232 with the top 218 and bottom 220 walls of the receptor member 200 forces the top 206 and bottom 228 walls of the receptor member 200 apart since the dimension D is greater, by preferably approximately 0.008 inches, than the dimension H. While the top 206 and bottom 288 walls of the receptor member 200 are forced apart, they are not forced apart to a large enough extent to permanently deform the receptor member 200 to permanently increase the H dimension. Rather, the top 206 and bottom 228 walls are forced apart in a resilient manner such that when the connector member 212 is fully pivoted to the position shown in FIG. 28, the top 206 and bottom 228 walls of the receptor member 200 return back to their original position. This "snap fit" reduces the likelihood that the connector member 212 would be accidentally pivoted to the upright position shown in FIG. 26 from the seated position shown in FIG. 28. This is the same fundamental interference type of fit utilized in the third embodiment shown in FIGS. 9–16, and described above. The important feature is that the dimension D of the cross member 212 is greater than the dimension H of the receptor member 200 such that when the cross member 216 is pivoted in the recess 226 of the receptor member, the cross member 216 resiliently forces the upper 206 and lower 228 walls of the receptor member 200 to resiliently move apart.

An optional feature applicable to the first three embodiments shown in FIGS. 1–16 includes a pair of guide rails 234, 236 formed on the inner surface 238 of the receptor member 240 which act to position the connector member 242 by providing guides for the ends 244, 246 of the cross member 248 of the connector member 242. The rails 234, 236 are positioned on the inner surface 238 of the bottom 250 and top 252 walls of the receptor member 240, and extend coextensively with the channel 254. The rails extend 0.010 inches above the surface on which they are formed.

Figure 32:
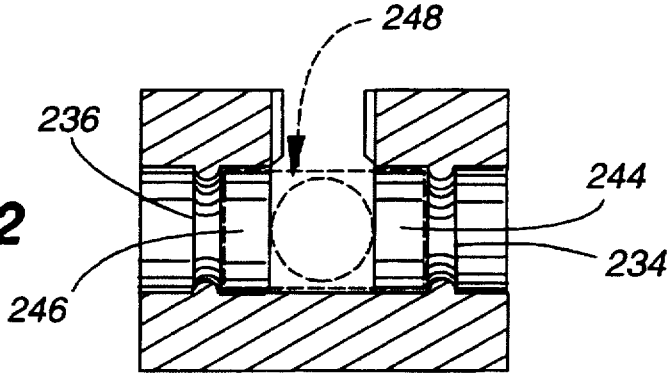
FIG. 32 is a section taken along lines 32—32 of FIG. 30.

When the cross member 248 of the connector member 242 is inserted through the channel 254 recess of the receptor member 240, the rails 234, 236 are positioned outside of the ends of the cross member 248 to assist in insuring that the cross member 248 is in the proper position prior to the pivoting movement, and also aids in the translation of the cross member 248 toward the second end 256 of the channel 252 prior to the pivoting movement to position the cross member 248 into the seated position. FIG. 32 shows the orientation of the cross member 248 with respect to the guide rails 234, 236 when the cross member 248 is seated in the second end 256 of the channel 254.

Finally, it is contemplated that the snap fit actuation on the shaft by the channel of the first two embodiments can be combined with the snap fit of the upper and lower walls of the receptor member on the cross member of the connector member as described with respect to the third and fourth embodiments of the present invention to provide a clasp with additional security features.

Presently preferred embodiments of the present invention and many of its improvements have been described with a degree of particularity. It should be understood that this description has been made by way of preferred example, and that the invention is defined by the scope of the following claims.

We claim:

1. A clasp comprising:

a receptor member having a surface defining a slot formed therethrough, and having a first and second end, a connector member having a shaft, said shaft having a first end defining a cross member extending transversely of said shaft, said shaft having a thickness dimension; and said slot having opposing walls defining a width dimension at said first and second ends larger than said thickness dimension of said shaft and a width dimension intermediate said first and second ends where said width dimension is less than said thickness dimension of said shaft;

said shaft being positionable in said slot and moveable along said slot from said first end to said second end, through said width dimension intermediate said first and second ends and biasingly displacing said opposing walls to pass therethrough, to releasably retain said shaft in said second end and connect said connector member to said receptor member.

2. A clasp as defined in claim 1, wherein said slot has a first end defining a laterally extending aperture for receiving said cross member.

3. A clasp as defined in claim 1, further comprising means for clamping said shaft at said second end of said channel.

4. A clasp as defined in claim 1, wherein:

said receptor member has an upper wall, a lower wall and an end wall, and a recess defined by said upper, lower and end walls;

said slot formed through said upper wall and said end wall, and extending from a first end on said upper wall to a second end on said end wall;

said cross member positionable through said slot to engage said end wall of said receptor member;

said connector member moveable between an upright position and a seated position to resiliently separate said upper and lower walls during movement between said upright position and said seated position.

5. A clasp as defined in claim 4, further comprising:

a sloped recess formed in said upper wall adjacent to said slot to align the cross member for insertion through said slot.

6. A clasp as defined in claim 1 for use in attaching a pendant to an earring, the earring having a main earring from which a shaft extends, and a clasp, wherein:

said receptor member is adopted for attachment to the main earring; and said connector member is adopted for attachment to the pendant.

7. A clasp as defined in 6, wherein said receptor member is releasably attachable to said main earring.

8. A clasp as defined in claim 1 for use in attaching a pendant to a necklace, wherein:

said receptor member is adopted for attachment to the necklace; and said connector member is adopted for attachment to the pendant.

9. A clasp comprising:

a receptor member having an upper wall, a lower wall and an end wall, and a recess defined by said upper, lower and end walls;

a slot formed through said upper wall and said end wall, and extending from a first end on said upper wall to a second end on said end wall;

a connector member having a main body, a shaft extending outwardly from said main body, said shaft having a distal end, and a cross member at said distal end and extending transversely therefrom;

said cross member positionable through said slot when said cross member is aligned longitudinally with respect to said slot, and reoriented when said cross member is in said cavity to be retained in said cavity.

10. A clasp as defined in claim 9, wherein said shaft is substantially cylindrical.

11. A clasp as defined in claim 9, wherein said shaft has longitudinally extending edges, said edges being chamfered.

12. A clasp as defined in claim 9, wherein:

said connector member is moveable between an upright position and a seated position to resiliently separate said upper and lower walls during movement between said upright position and said seated position.

13. A clasp as defined in claim 9 for use in attaching a pendant to an earring, the earring having a main earring from which a shaft extends, and a clasp, wherein:

said receptor member is adopted for attachment to the main earring; and said connector member is adopted for attachment to the pendant.

14. A clasp as defined in 13, wherein said receptor member is releasably attachable to said main earring.

15. A clasp as defined in claim 9 for use in attaching a pendant to a necklace, wherein:

said receptor member is adopted for attachment to the necklace; and said connector member is adopted for attachment to the pendant.

16. A clasp as defined in claim 9, wherein said connector member is movable along said slot to engage said end wall of said receptor member.

17. A clasp as defined in claim 16, wherein:

said upper, lower and end walls define a continuous inner surface exposed to said recess; and further comprises:

a pair of spaced-apart guide rails formed on said inner surface, said guide rails extending coextensively with said slot to align the cross member when moving in said recess.

18. A clasp comprising:

a receptor member having a surface defining a slot formed therethrough, and having a first and second end;

a connector member having a shaft, said shaft having a first end defining a cross member extending transversely of said shaft;

said shaft being positionable in said slot, said connector member moveable between an upright position and a seated position in said slot to resiliently separate said upper and lower walls during movement between said upright position and said seated position to releasably retain said shaft in said slot and connect said connector member to said receptor member.

19. A clasp as defined in claim 18, wherein said shaft is moveable along said slot from said first end to said second end, and said cross member is retained in said seated position at said second end.

20. A clasp as defined in claim 19, wherein receptor member has an endwall at said second end, and said cross member engages said endwall when seated in said second end.

21. A clasp as defined in claim 18 for use in attaching a pendant to an earring, the earring having a main earring from which a shaft extends, and an earring clasp, wherein:

said receptor member is adopted for attachment to the main earring; and said connector member is adopted for attachment to the pendant.

22. A clasp as defined in 21, wherein said receptor member is releasably attachable to said main earring.

23. A clasp as defined in claim 18 for use in attaching a pendant to a necklace, wherein:

said receptor member is adopted for attachment to the necklace; and said connector member is adopted for attachment to the pendant.

* * * * *